US005351841A

United States Patent [19]

Belokin et al.

[11] Patent Number: 5,351,841

[45] Date of Patent: Oct. 4, 1994

[54] MERCHANDISE CASE WITH ADVERTISING DISPLAY

[76] Inventors: Paul Belokin; Martin P. Belokin, both of P.O. Box 1907, Denton, Tex. 76202; Norman P. Belokin, 3341 Evers Pkwy., Denton, Tex. 76207

[21] Appl. No.: 22,474

[22] Filed: Feb. 25, 1993

[51] Int. Cl.[5] ..... A47F 5/00

[52] U.S. Cl. ..... 211/88; 211/90; 248/206.3

[58] Field of Search ..... 211/88, 90, 128, 135, 211/75; 248/206.3, 206.4, 205.5

[56] References Cited

U.S. PATENT DOCUMENTS

| | | | |
|---|---|---|---|
| D. 171,595 | 3/1954 | Harriton | 248/206.3 X |
| 1,243,059 | 10/1917 | Friesleben | 211/90 |
| 1,933,374 | 10/1933 | Haggard | 211/90 X |
| 2,122,336 | 6/1938 | Berry | 211/88 |
| 3,182,809 | 5/1965 | Getoor | 211/88 |
| 4,376,521 | 3/1983 | Walters | 248/206.3 |
| 4,928,833 | 5/1990 | Huizenga | 211/90 X |
| 4,984,693 | 1/1991 | Belokin et al. | 211/88 |
| 5,014,860 | 5/1991 | Emery | 211/88 X |
| 5,141,115 | 8/1992 | Nicoll | 211/88 X |

FOREIGN PATENT DOCUMENTS

| | | | |
|---|---|---|---|
| 552195 | 11/1956 | Italy | 211/90 |

*Primary Examiner*—Robert W. Gibson, Jr.
*Attorney, Agent, or Firm*—Jack A. Kanz

[57] ABSTRACT

A merchandise display case is formed with opposed sides defining an open rear face with one or more shelves extending horizontally between and connecting the opposed sides. The display unit is mounted on a window with the open rear face adjacent the window. Suction cups attached to the case support the case on the window and advertising materials are supported on the stems of the suction cups between the case and the window and/or extend laterally from the case to be readily visible from both sides of the window.

36 Claims, 8 Drawing Sheets

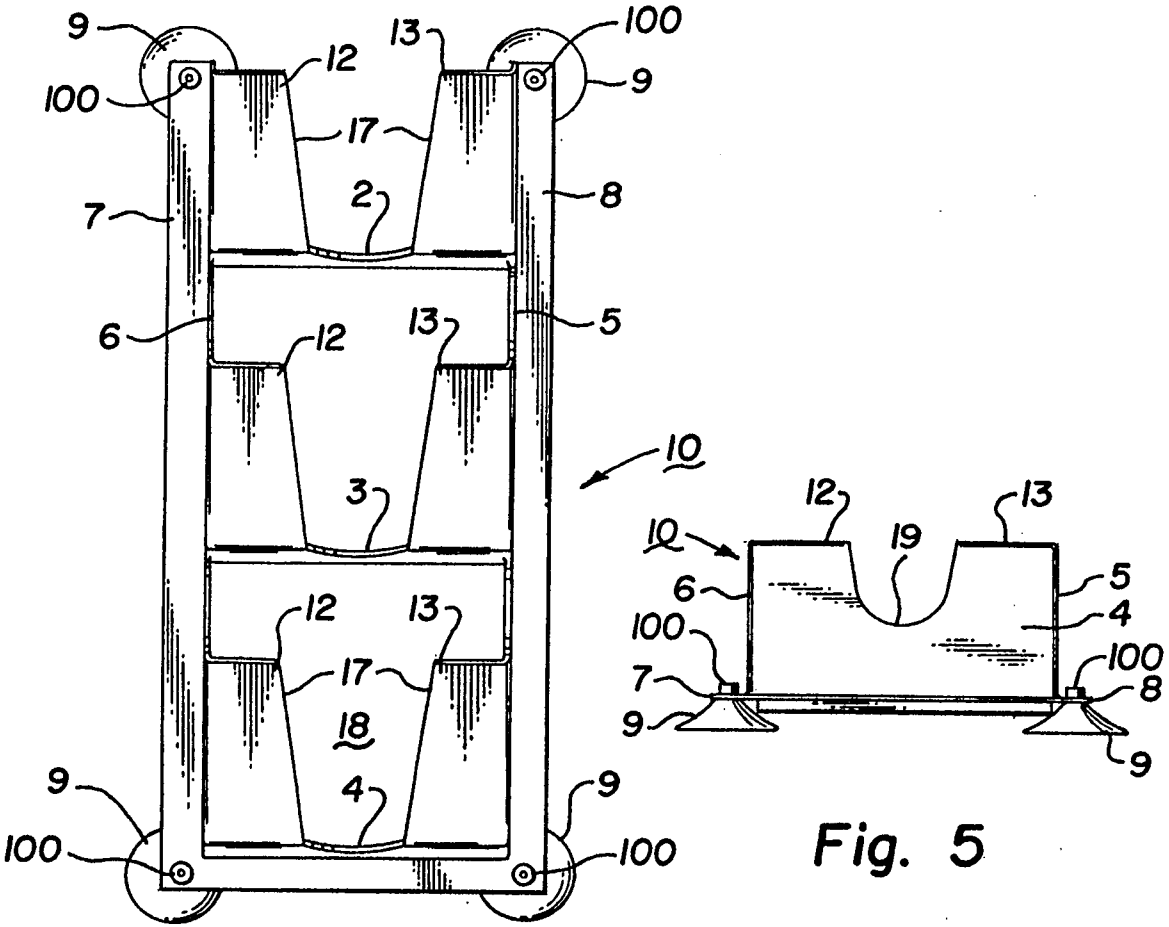
Fig. 4
Fig. 5
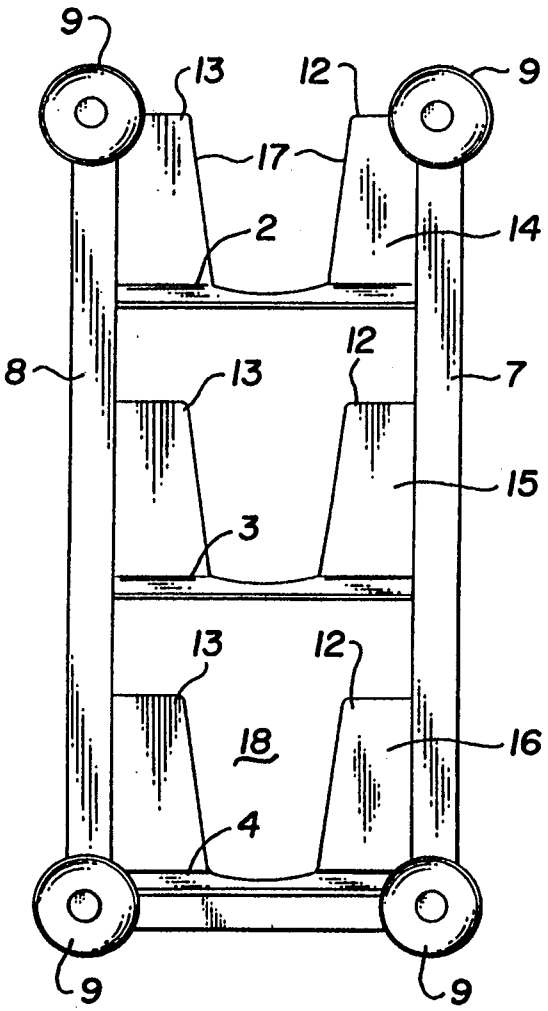
Fig. 3

MERCHANDISE CASE WITH ADVERTISING DISPLAY

Merchandise display shelves, racks and the like are widely used in retail outlets to store and simultaneously display products and advertising for such products. In many shops, especially convenience stores and the like, floor space is at a premium. Therefore, displays which occupy minimum floor space are preferred. Product display shelves which allow the customer to readily see the products are highly desireable and, because sales are often made on impulse, the display shelf and product advertising display should be visually pleasing and sufficiently attractive to quickly catch the attention of the prospective customer.

Retail outlets, especially convenience stores, depend mostly on signs or other visual displays to act as advertisements which lure customers into the store or spur a customer already in the store to purchase a product. Therefore, a merchandise shelf should be configured to permit the product to be displayed and seen from all sides, including outside the store. In addition to the desireable features outlined above, a display shelf should also be easily mountable and removeable, inexpensive and durable and should allow products to be easily loaded and removed therefrom.

The shortcomings of the prior art are illustrated in U.S. Pat. Nos. 3,139,258 and 2,826,471 which disclose tray shelving mounted with screws or pegs on wood or similar nontransparent supports. These shelves cannot be mounted on a window and cannot be mounted on any surface without permanently marring the surface. U.S. Pat No. 4,984,693 discloses a product display shelf which has no back wall but leaves a small gap between the shelf and the mounting surface which allows products to fall between the shelf and the mounting surface. This shelf has only one tier, thus severely limiting the number of products which may be placed on the shelf. None of the prior art shelves is designed for mounting at a location where the products displayed thereon are readily observable from outside the store.

In accordance with the present invention, a merchandise display case or unit is provided which can be detachably mounted on a window or other transparent wall. The display unit has opposed sides made of transparent material with rear edges defining an open rear face therebetween; first and second shelves (or more) extending generally horizontally between and connecting the opposed sides; and means for mounting the display unit on a transparent substantially vertical window or wall so that the open rear face is disposed adjacent the transparent wall.

The mounting means preferably comprises a plurality of suction cups, each having a stem connected to the display unit and a suction head facing rearwardly of the display unit for attachment to the supporting wall. Preferably, the rear sides of the unit have outwardly extending flanges which are adapted to mate with the stems of the suction cups for mounting the unit. The merchandise display unit may include one or more additional shelves located between the first and second shelves, the additional shelves extending generally horizontally between the opposed sides and extending rearwardly of the rear face.

The display unit of the invention preferably has first and second front walls extending upwardly from the front edges of the shelves with each front wall formed of two segments having facing inner peripheries which define an access opening therebetween. The first front wall preferably has an upper surface spaced from the bottom surface of the immediately adjacent shelf by a sufficient distance to permit insertion of at least a portion of the merchandise product between the upper surface of the first front wall and the bottom surface of the adjacent shelf. The shelves of the display unit preferably extend rearwardly of the open rear face so as to prevent products from slipping between the support shelf and the window.

In one embodiment of the display unit a vertically oriented display card or advertising panel is disposed between the rear face of the display unit and the mounting surface. The display panel is thus visible to prospective customers from outside or inside the store. Similarly, an ultra-violet shield may be disposed between the rear face of the display unit and the inner surface of the support wall to protect the displayed product from ultra-violet radiation.

In another embodiment the invention includes display panels which attach to the stems of the suction cups and extend downwardly and/or outwardly from the display case. These display panels may also be observed from both inside and outside the store.

Various embodiments of the invention (and their unique applications) provide self-advertising merchandise dispensing displays which occupy no floor space; attract potential customers both inside and outside the store; can be readily installed and removed without damaging the support surfaces; and can support removable and replaceable advertising. Other features and advantages of the invention will become more readily understood from the following detailed description taken in connection with the appended claims and attached drawing in which:

FIG. 1 is a perspective view of one embodiment of the display case of the invention mounted on a transparent wall of a store or the like;

FIG. 3 is a back view of the display unit of FIG. 1;

FIG. 4 is a front view of the display unit of FIG. 1;

FIG. 5 is a bottom view of the display unit of FIG. 1;

FIG. 9 is a perspective view of an alternate embodiment of a merchandise display unit constructed in accordance with the invention mounted on a transparent wall of a store or the like;

Figure 1:
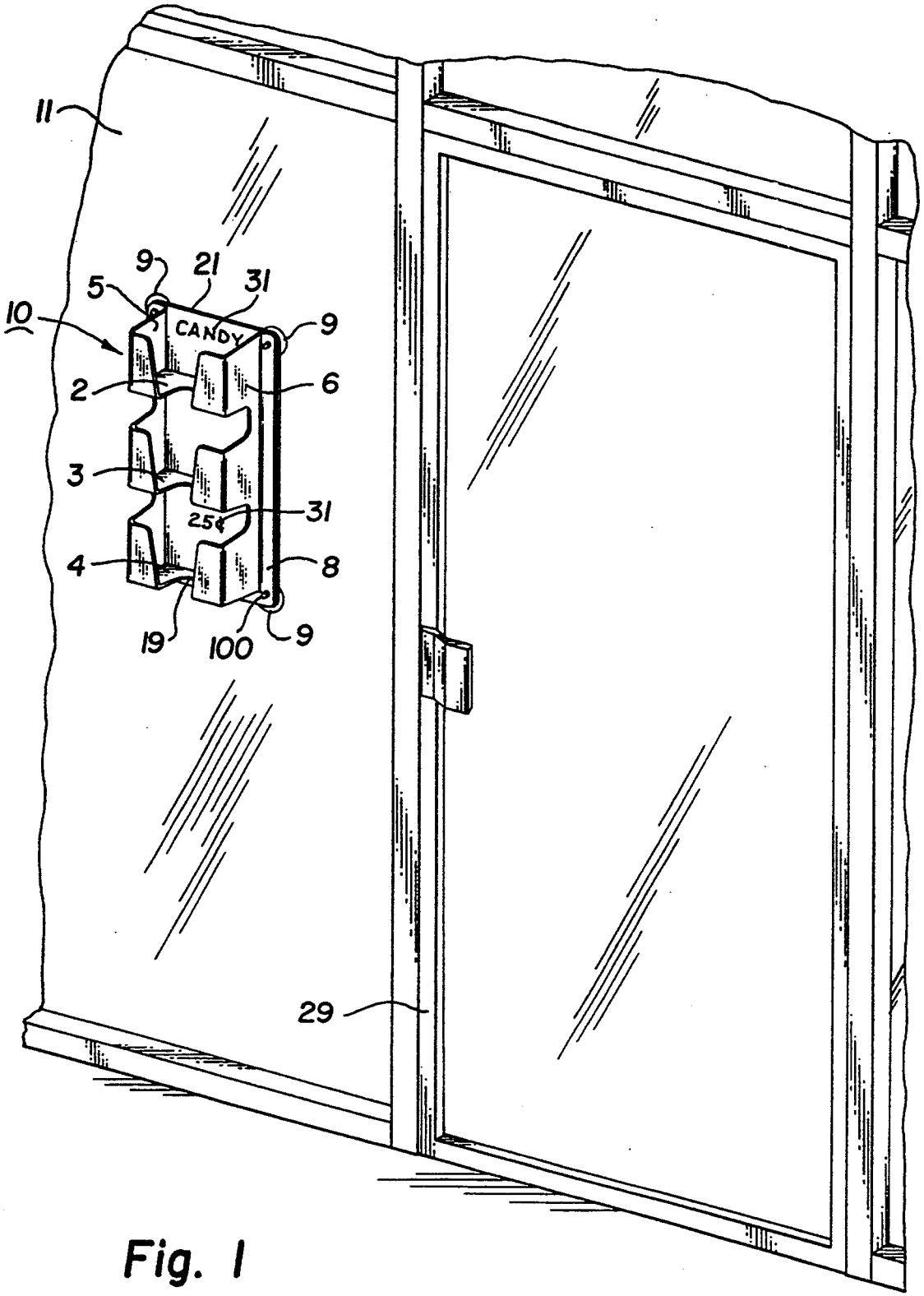

The merchandise display unit of the invention is illustrated in FIGS 1–12 as a shelf unit which can be mounted on a window 11 so that it is visible from both inside and outside the store. The unit 10 thus acts as an advertisement and also frees valuable floor space for other uses. The display unit could also be mounted on the outside surface of a store window, etc., for a sidewalk sale or the like and, because it is easily detachable, be taken down at night or relocated for optimum placement.

As used herein, the terms "horizontal" and "vertical" have reference to the merchandise supporting shelves when the unit is in its normal installed position.

Merchandise display unit 10 has a first horizontal shelf 2 for holding and displaying products. Second shelf 3 and third shelf 4 are disposed below the first shelf 2. The shelves 2–4 extend generally horizontally between two opposed sides 5, 6 which define an open rear face therebetween.

Figure 2:
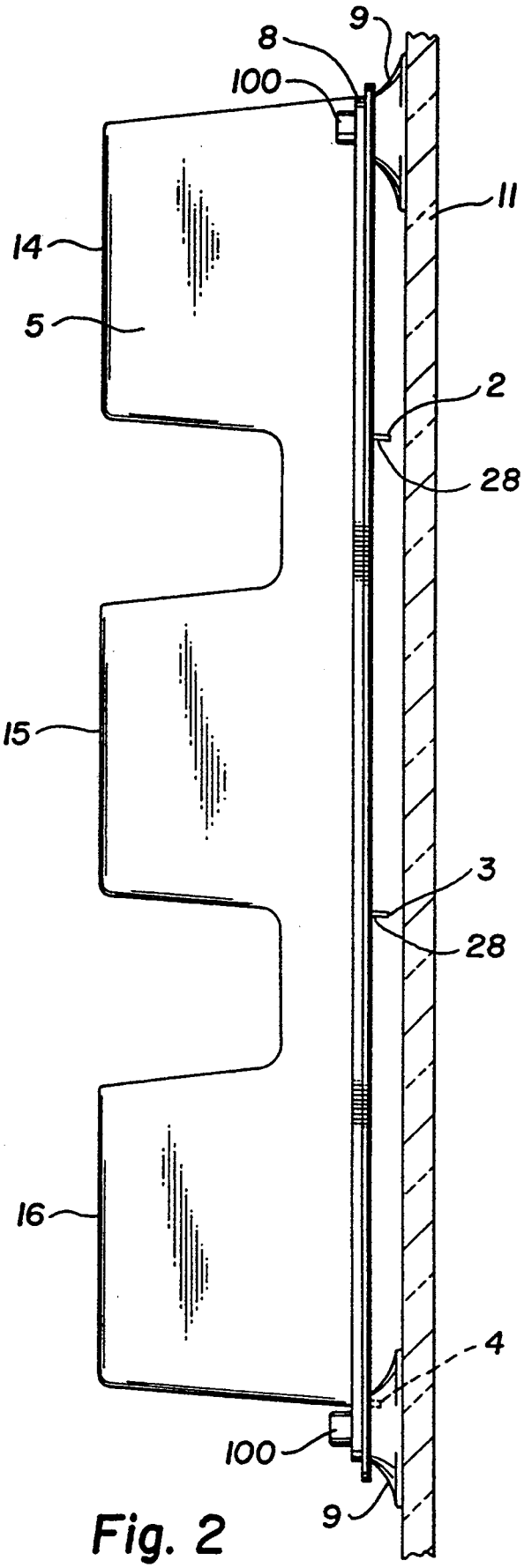
FIG. 2 is a side view of the display unit of FIG. 1.
Figure 6:
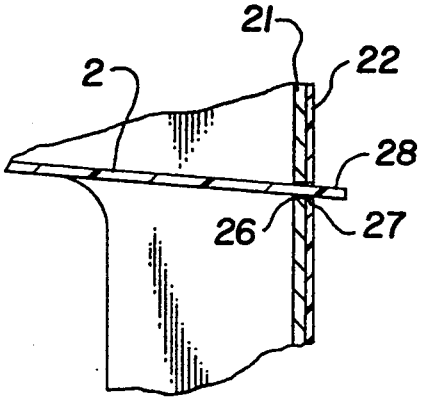
FIG. 6 is an enlarged partial side view of the display unit of FIG. 1 illustrated in cross-section.
Figure 7:
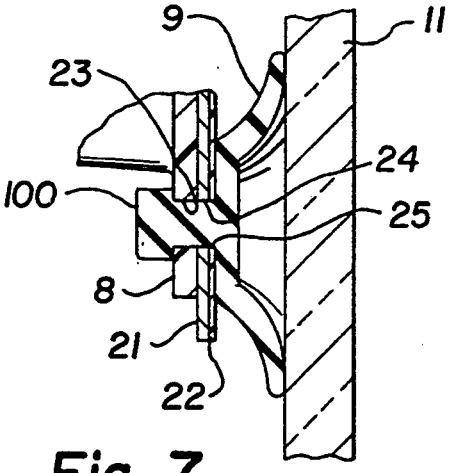
FIG. 7 is a sectional detail of the suction cup mounting arrangement used to support the display unit of FIG. 1.

As can be seen in FIG. 2, the rear edges 28 of shelves 2–4 extend rearwardly beyond the open rear face. When mounted against the window 11 this arrangement permits the rear edges 28 of shelves 2–4 to be very near or in contact with the window, thus preventing products on shelves 2–4 from falling between the shelves and the window 11.

As shown in FIG. 5, each shelf 2–4 has an U-shaped cut-out which permits a hand to be inserted into the display shelf for product removal and which also allows products to hang from the shelf. Flanges 7, 8 extend outwardly from the rear edges of the opposed sides 5, 6 of display unit 10 to define rear wall members. Stems 100 of suction cups 9 are secured to the flanges 7, 8 of the display unit 10 through holes 23 formed in flanges 7, 8. The suction cups permit the display unit 10 to be mounted on a window or other smooth surface without marring the surface and also permit removal and relocation of the unit for optimum display at different times. At least three suction cups should be used for mounting the display unit 10. If less than three suction cups are used, failure of any one cup can upset the display. However, if three or more are used, failure of any one cup has no immediate effect and can be corrected before the display is accordingly dislodged from the mounting surface.

Extending upwardly from each shelf 2–4 are first and second front wall segments 12, 13 defining front walls 14–16. The two wall segments 12, 13 extending from each shelf have facing inner peripheries 17 defining an access opening 18 which allows the displayed merchandise to be clearly seen and also permits easy access to the merchandise. As seen in FIGS. 2 and 3, the front walls 14–16 are spaced vertically from each other to provide ample space between the top of one wall 15, 16 and the bottom of the adjacent shelf 2, 3 to permit product insertion and removal from each shelf 3, 4.

The display unit 10 is preferably molded from clear plastic to form an integral, durable display unit. Molding permits inexpensive manufacturing using a single cavity with no side cores. Clear plastic is preferable so that displayed merchandise can be readily seen through the shelves and walls of the unit.

Figure 8:
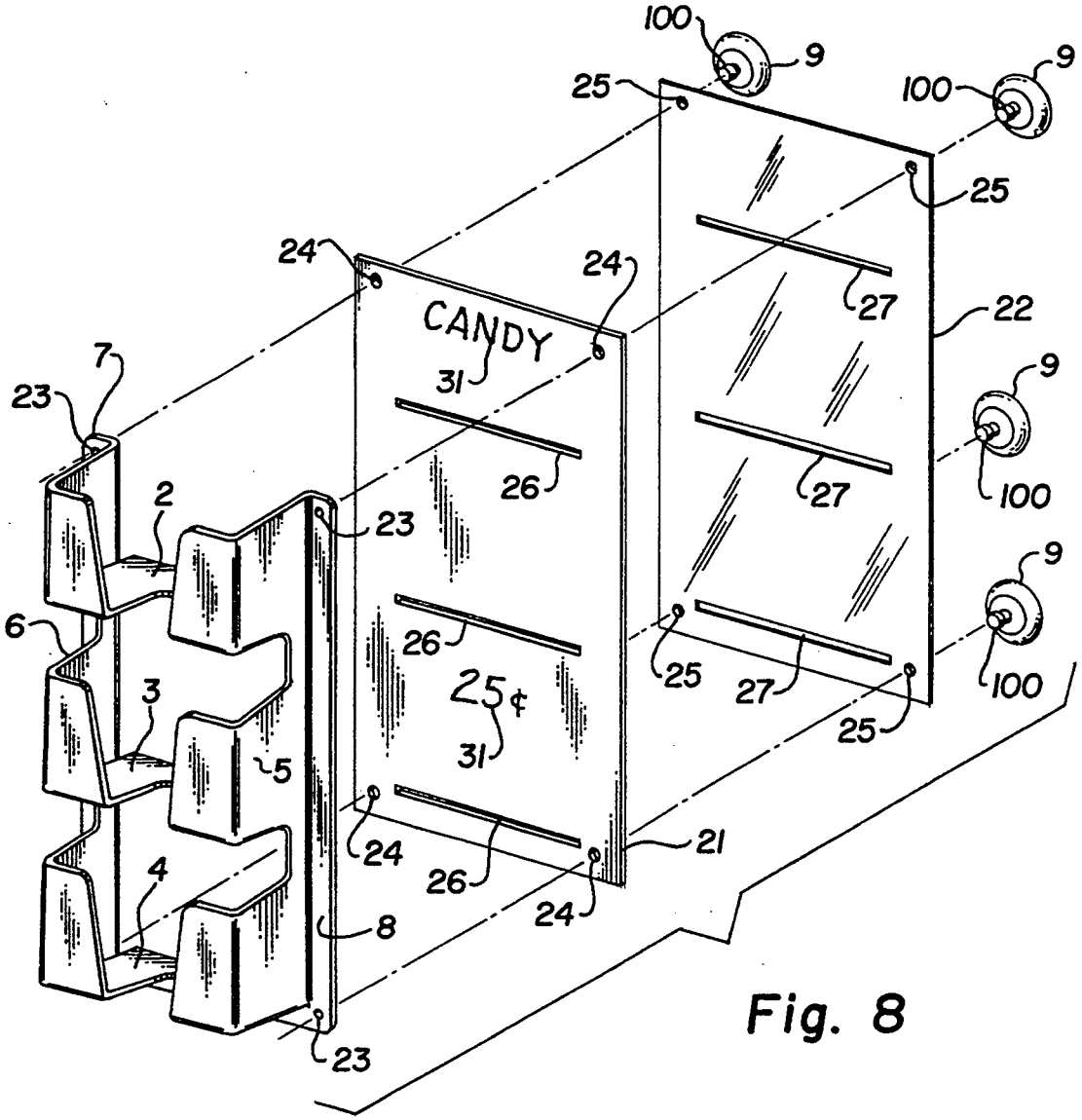
FIG. 8 is an exploded view of the display unit of FIG. 1.

As illustrated in FIGS. 1 and 8, the merchandise display unit 10 includes a removeable advertising display panel 21 and an ultra-violet shield 22. In the preferred use of the invention, the unit 10 is suspended on window 11 at a location (such as the front of a store adjacent door 29) where prospective customers are likely to see the products displayed. Display unit 10 should be mounted at about eye level to maximize its aesthetic appeal. The removeable display panel 21 is mounted between the rear face of the display unit 10 and the inner surface of the window 11. The display panel 21, best seen in FIG. 8, is preferably a sheet having indicia 31 such as advertising copy or the like printed thereon. The display panel 21 may be a transparent sheet, cardboard or any other material which can carry advertising indicia. The display panel 21 preferably has holes 24 aligned for mounting display panel 21 on the stems 10 of suction cups 9 as shown in FIG. 8. This mounting arrangement greatly facilitates assembly by obviating the need for providing separate connectors for mounting the display panel 21 onto the display unit 10 or the window 11. Furthermore, this obviates the need for separate hangers for the display panel 21 and also saves space on the window 20 by permitting stacking of the display panel 21 and the display unit 10.

Note that the display panel 21 need not be the same size as the rear face of display unit 10. The display panel 21 may only cover a portion of the back of the display unit 10 or may hang below the display unit. The display panel 21 may also have slots 26 for receiving the rear edges of shelves 2–4.

An ultra-violet shield 22 may be disposed on either side of the display panel 21 to prevent damage to the unit 10 and the products stored and displayed thereon form ultra-violet radiation. The ultra-violet shield 22 is preferably composed of film with mounting holes 25 to receive the stems 10 of the suction cups 9 and may also contain slots 27 for receiving the rear edges 28 of shelves 2–4.

To display products using the merchandise unit 10, the unit 10 is mounted on the inner surface of a window or transparent wall of a store. The unit 10 may support a display panel 21 with advertising indicia thereon between the rear face of the unit and the window 11. An ultra-violet shield 22 may be positioned between the display panel 21 and the window or between the unit 10 and the display panel 21. Of course, the unit 10 could be used without the display panel 21 or the shield. Since the window is transparent and the unit 10 has an open rear face, products placed on the shelves 2–4 are readily observable from both inside the store and outside the store. Thus the products displayed serve as an advertisement. Furthermore, advertising copy or other indicia 31 printed on the outer surface of display panel 21 can be read from some distance, thus pre-selling the product to customers before they ever see the product. At the same time, valuable floor space is conserved since the entire unit 10 is mounted on window 11. Moreover, the merchandise display case, with or without the ultra-violet shield, acts as a sun screen and helps to save energy by keeping the store cooler. It will be readily recognized that the display panel 21 can be removed and replaced as desired. Thus the unit 10 may be used to display and advertise different merchandise by simply replacing the merchandise and inserting a new display panel 21 with appropriate advertising indicia 31.

An alternative embodiment of the invention is illustrated in FIGS. 9–12 comprising a display unit 101 mounted on a window 120 of a store. As discussed hereinabove, the display unit 101 should be mounted adjacent a door 129 and at eye level for optimum customer contact. In this embodiment, the merchandise display unit 101 has a first horizontal shelf 102 for holding products 140. A second horizontal shelf 103 is disposed directly below the first horizontal shelf 102. The shelves 102, 103 extend generally horizontally between two opposed sides 105, 106 which define an open rear face.

Figure 11:
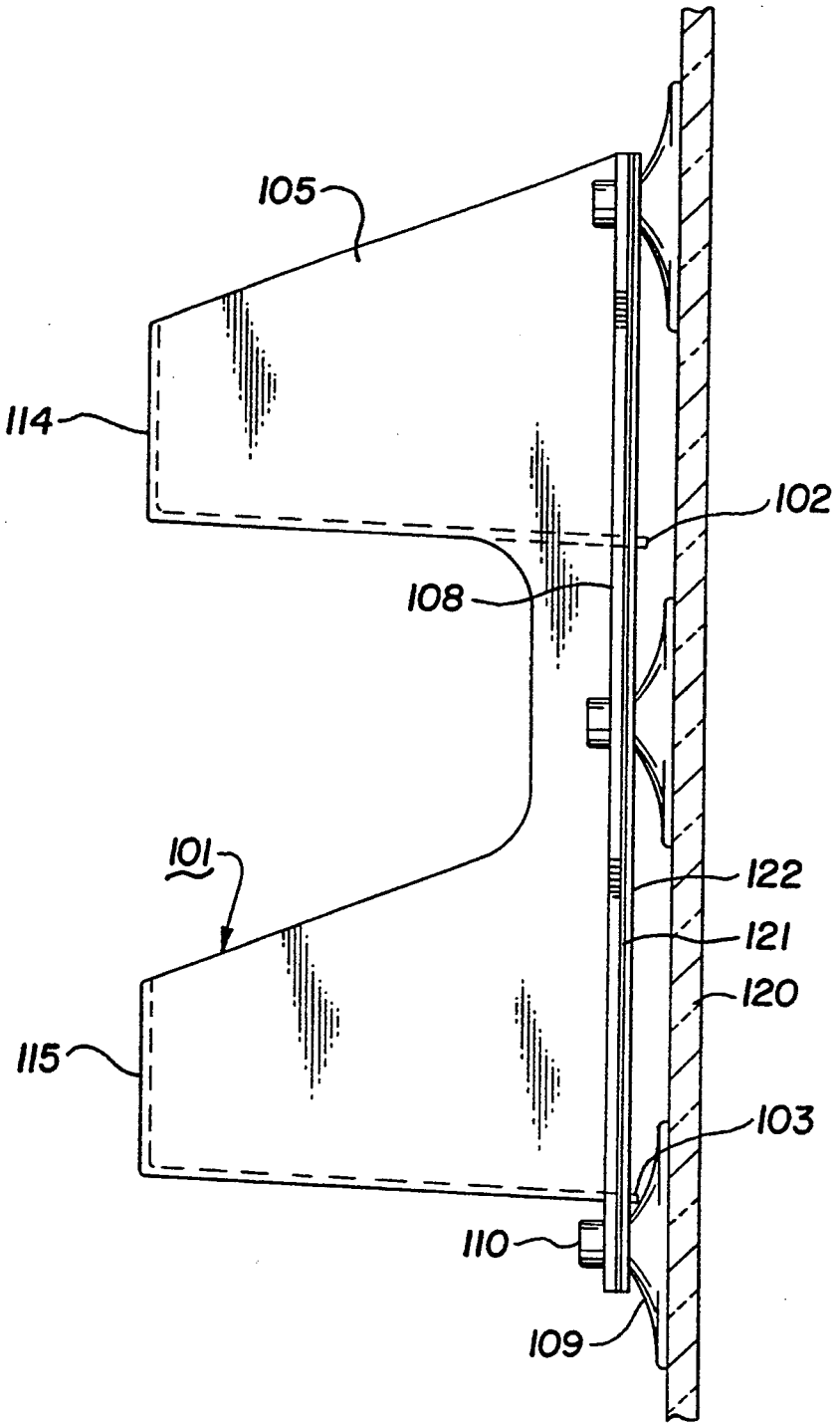
FIG. 11 is a side view of the display unit of FIG. 9.

As shown in FIG. 11, the rear edges of horizontal shelves 102, 103 extend rearwardly beyond the open rear face. When mounted against window 120, this arrangement permits the rear edges of the shelves 102, 103 to be very near or adjacent the window, thus preventing products 140 from falling between the shelves 102, 103 and the window 120.

Flanges 107, 108 extend outwardly from the rear of the opposed sides 105, 106 of display unit 101 to define rear wall members. The flanges 107, 108 are mounted on stems 110 of suction cups 109. The suction cups 109 permit the display unit 101 to be mounted on window 120 without marring and permit removal and relocation of the unit for optimum display at different times.

Extending upwardly from shelves 102, 103 are front walls 114, 115, respectively. The front walls 114, 115 extend across the length of shelves 102, 103 and provide surfaces suitable for advertising and the like illustrated as indicia 141 (see FIG. 9). The front walls 114, 115 also prevent products 140 from falling from the shelves. As seen in FIG. 11, the top of front wall 115 is spaced vertically from the adjacent shelf 102 to provide ample space between the top of wall 114 and shelf 102 to permit insertion and removal of product 140 from shelf 103.

Figure 12:
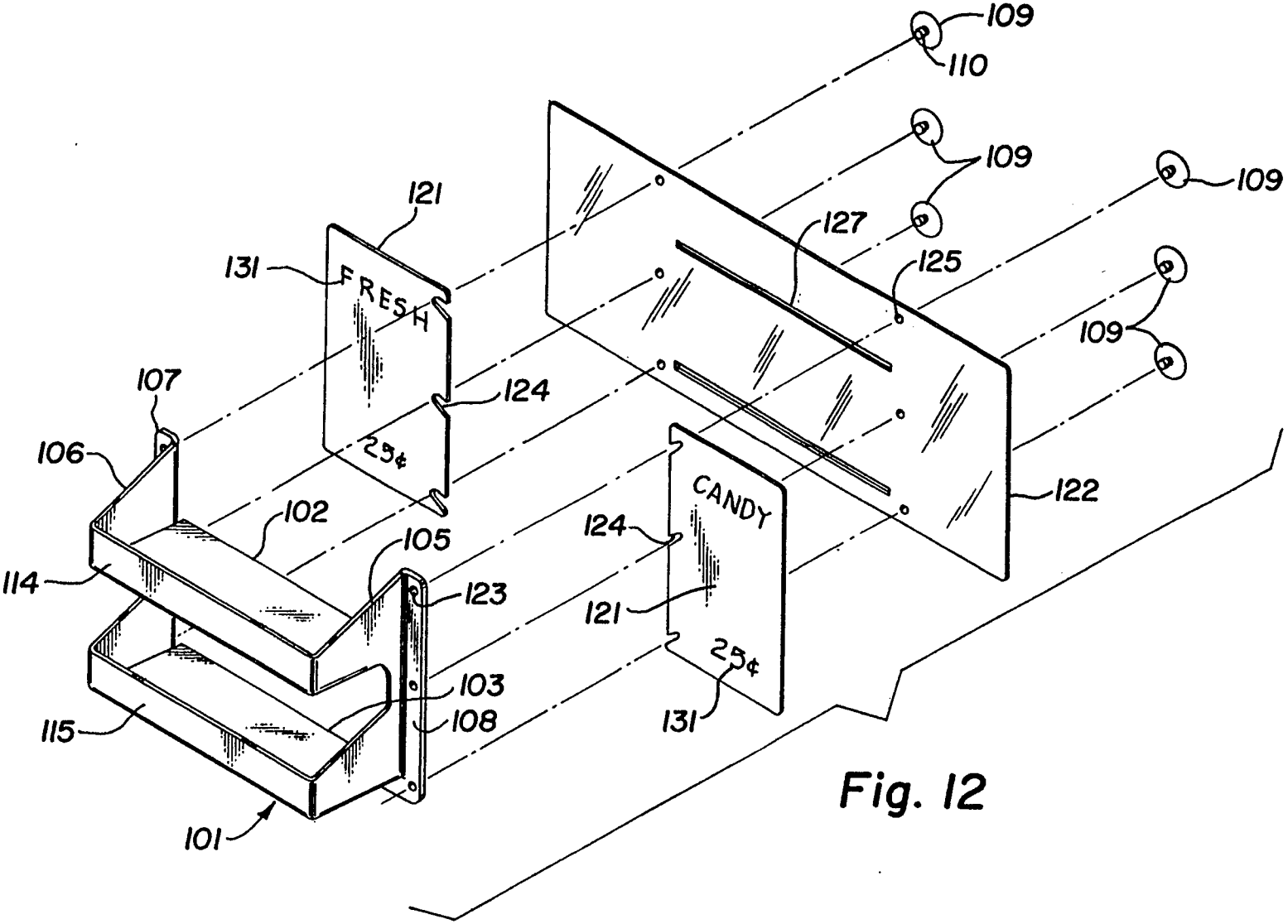
FIG. 12 is an exploded view of the display unit of FIG. 9.

As illustrated in FIG. 12, a display panel 121 and an ultraviolet shield 122 may be employed and display panels may be suspended laterally from the opposed sides 105 and 106 of unit 101 via hooks or slots 124 formed in the display panel. Such display panels may be hung on the stems 110 of suction cups 109 without removing the case 101 form the suction cups if the stems 110 are appropriately designed. Where the stem is sufficiently long to permit the display panel 121 between the flanges and the window, the panels 121 are inserted between the flange 108 and the window while the unit is mounted on the window. The hooks or slots 124 thus facilitate mounting and permit replacement or substitution of the display panel 121 with a display bearing different indicia without detaching the unit 101 from the window.

Figure 9:
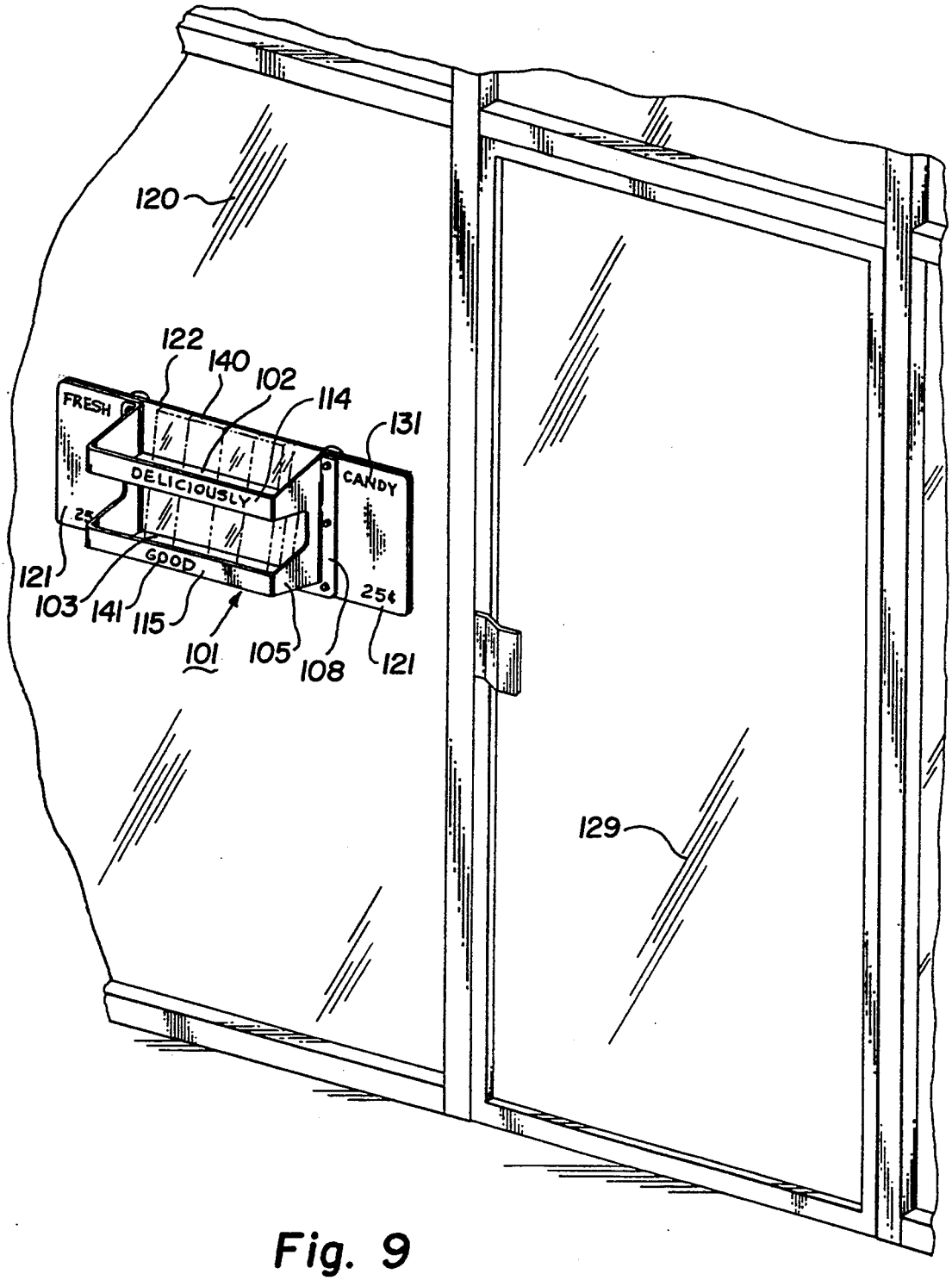
Figure 10:
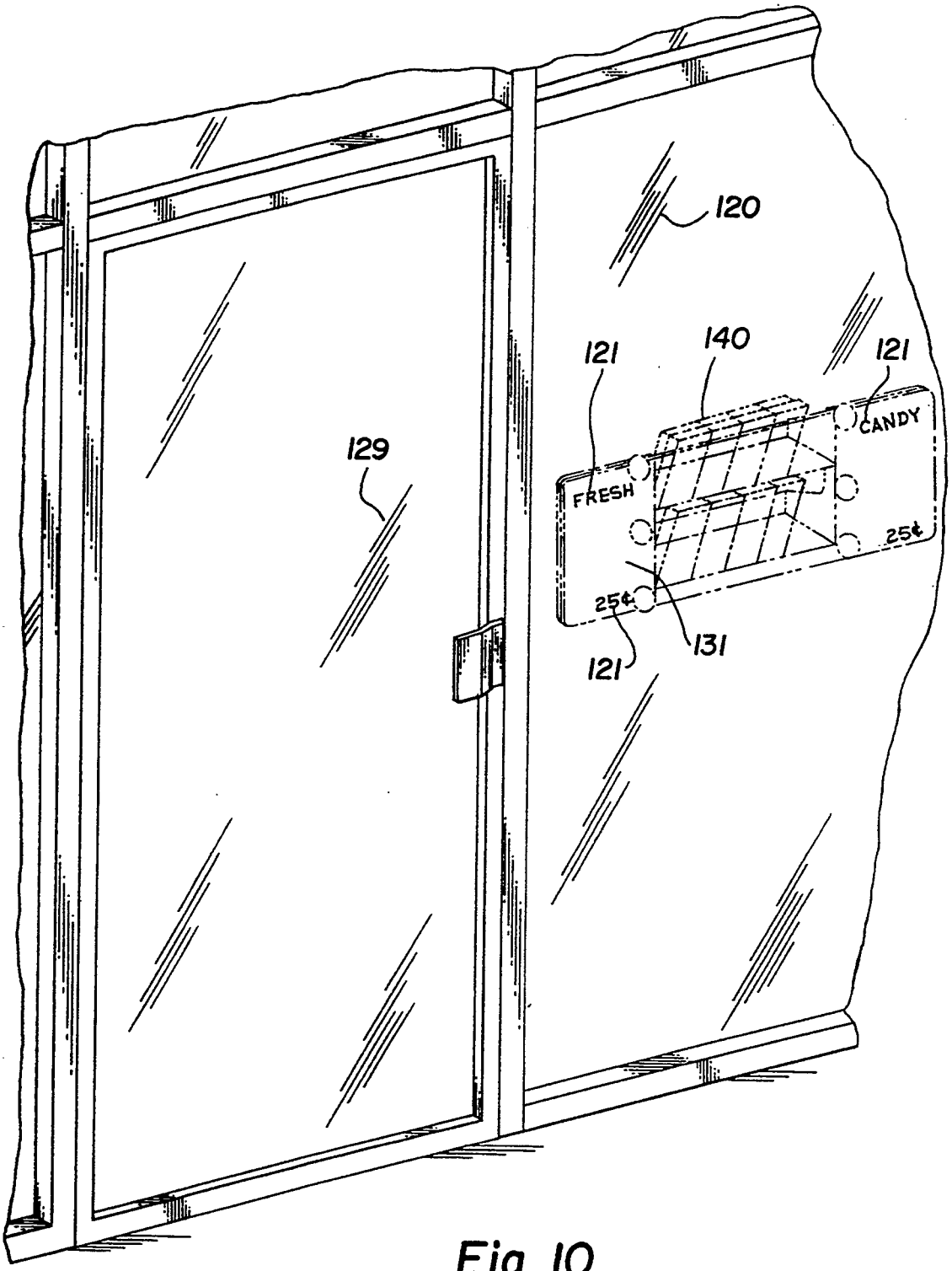
FIG. 10 is a perspective view of the display unit and wall of FIG. 9 as seen from outside the store.

The display panel 121 may extend laterally past either or both the flanges 107, 108 to provide extra advertising space (see FIGS. 9 and 12). Most importantly, indicia 131 may be placed on both sides of the display panel 121, thereby attracting customers from outside as well as inside the store. Display panel 121 may be mounted on only one side or on both sides of the unit 101. Display panel 121 may, if desired, be generally U-shaped (not shown) to provide a more permanent mounting thereof on merchandise unit 101 while permitting the rear face of the unit to remain open, thereby leaving any products 140 on the shelf free from obstruction.

An ultra-violet shield 122 may be disposed adjacent either the front or rear face of the display panel 121 or may be used without the display panel 121. The shield 122 may be sized to the display panel 121 or may cover the entire rear face of the unit 101. Holes 125 and slots 127 are provided for mounting the shield on the rear edges of the shelves.

It will be readily recognized that the number, shape and spacings of shelves used in the merchandise case of the invention may be varied as desired to accommodate specific shapes and sizes of units of merchandise. Nevertheless, because of the unique open back design of the merchandise case, visibility of the product is optimized. Similarly, because of the open back design of the case and its unique mounting, display panels containing advertising indicia and the like can be inserted between the merchandise unit and its support wall or adjacent the unit on either side, below or above the unit. Since the display panels 21, 121 are removeable and replaceable, advertising indicia can be varied to suit the particular merchandise displayed. The display case is thus extremely versatile and useable in connection with a wide variety of merchandise.

Although the invention has been described with particular reference to specific embodiments thereof, it is to be understood that the forms of the invention shown and described are to be taken as preferred embodiments. Various changes, substitutions and modifications may be resorted to without departing from the spirit and scope of the invention as defined by the appended claims.

What is claimed:

1. A merchandise display comprising:

(a) a substantially transparent window of a store having first and second opposite surfaces visible and accessible to prospective customers of said store;

(b) a display case including i. opposed sides having rear edges defining an open rear face therebetween;

ii. a first shelf extending generally horizontally between said opposed sides and extending rearwardly of said open rear face supporting products which are readily observable to prospective customers from either side of said window; and iii. a second shelf located above said first shelf extending generally horizontally between said opposed sides and extending rearwardly of said rear face; and (c) means for mounting said display case on one surface of said window with said rear face adjacent said one surface.

2. A merchandise display as defined in claim 1 wherein said means for mounting comprises a plurality of suction cups, each having a stem connected to said display case and a suction head facing rearwardly of said opposed sides.

3. A merchandise display as defined in claim 1 further comprising a removeable display panel disposed between the display case and the inner surface of said window, said display panel having indicia formed thereon readable by said prospective customers.

4. A merchandise display as defined in claim 3 wherein said display panel has mounting holes formed therethrough which receive the stems of suction cups to support said display panel.

5. A merchandise display as defined in claim 1 further comprising a display panel extending laterally beyond one of said opposed sides.

6. A merchandise display as defined in claim 5 further comprising a second display panel extending laterally beyond the other of said opposed sides.

7. A merchandise display as defined in claim 5 further comprising an ultra-violet shield disposed between the rear face of said display case and the inner surface of said window.

8. A merchandise display as defined in claim 7 wherein said ultra-violet shield has mounting holes formed therethrough which receive the stems of suction cups to support said ultra-violet shield.

9. A merchandise display as defined in claim 1 further comprising a front wall extending generally vertically upwardly from said support shelf and supporting indicia thereon.

10. A method of displaying merchandise comprising the steps of:

(a) mounting a display case on a window of a store, said display case including opposed sides having rear edges defining a rear face therebetween and a support shelf extending generally horizontally between said opposed sides connecting said opposed sides and extending rearwardly of said rear face, said mounting step comprising mounting said display case on said window with said rear face adjacent said window;

(b) positioning a display panel between said display case and said window and holding said display panel in place with said display case, said display panel having indicia formed thereon readily observable by said prospective customers; and (c) supporting merchandise on said shelf in a position which is readily observable by prospective customers from outside said store.

11. The method set forth in claim 10 further comprising the steps of positioning an ultra-violet shield between said display case and the inner surface of said window and holding said ultra-violet shield in place with said display case.

12. A merchandise display case comprising:

(a) a display unit including i. opposed sides having rear edges which define an open rear face therebetween;

ii. a first shelf extending generally horizontally between and connecting said opposed sides and extending rearwardly of said open face; and iii. a second shelf located above said first shelf, said second shelf extending generally horizontally between said opposed sides and rearwardly of said open face; and (b) means for removeably mounting said display unit on a substantially transparent support surface with said open rear face disposed adjacent said support surface.

13. A merchandise display case as defined in claim 12, wherein said means for removeably mounting comprises at least three suction cups, each having a stem connected to said display unit and a suction heat facing rearwardly of said opposed sides.

14. A merchandise display case as defined in claim 13 further comprising flanges extending outwardly from said rear sides to define rear wall members, and wherein said stems of said suction cups are connected to said flanges.

15. A merchandise display case as defined in claim 12 further comprising a third shelf located above said second support shelf, said third shelf extending generally horizontally between said opposed sides and extending rearwardly of said rear face.

16. A merchandise display case as defined in claim 13 further comprising a display panel having indicia on both sides thereof disposed adjacent said open rear face.

17. A merchandise display case as defined in claim 16 wherein said display panel is supported by the stems of said suction cups.

18. A merchandise display case as defined in claim 12 further comprising a display panel having indicia on both sides thereof and supported outwardly from said opposed sides of said display unit.

19. A merchandise display comprising:

(a) a display unit including i. opposed sides having rear edges which define an open rear face therebetween;

ii. a first shelf extending generally horizontally between said opposed sides and connecting said opposed sides;

iii. a second shelf located above said first shelf, said second shelf extending generally horizontally between said opposed sides; and (b) means for removeably mounting said display unit on a substantially transparent support surface with said open rear face disposed adjacent said support surface; and (c) first and second front walls extending upwardly from respective ones of said shelves, each of said front walls defining two segments with facing inner peripheries which define a product access opening therebetween.

20. A merchandise display case as defined in claim 19 wherein said upper surface of said first front wall is spaced from the bottom surface of said second shelf by a sufficient distance to insert at least a portion of a product between said upper surface of said first front wall and said bottom surface of said second shelf.

21. A merchandise display case as defined in claim 19 wherein said first and second shelves extend rearwardly of said open face.

22. A merchandise display case as defined in claim 19 wherein said means for removeably mounting comprises at least three suction cups, each having a stem connected to said display unit and a suction head facing rearwardly of said opposed sides.

23. A merchandise display case as defined in claim 22 further comprising flanges extending outwardly from said rear sides to define rear wall members, and wherein said stems of said suction cups are connected to said flanges.

24. A merchandise display case as defined in claim 22 further comprising a display panel having indicia on both sides thereof disposed adjacent said open rear face.

25. A merchandise display case as defined in claim 24 wherein said display panel is supported by the stems of said suction cups.

26. A merchandise display case as defined in claim 19 further comprising a display panel having indicia on both sides thereof and supported outwardly from said opposed sides of said display unit.

27. A merchandise display comprising:

(a) a substantially transparent window of a store having first and second opposite surfaces visible and accessible to prospective customers of said store;

(b) a display case including i. opposed sides having rear edges defining an open rear face therebetween; and ii. at least one shelf extending generally horizontally between said opposed sides and extending rearwardly of said open rear face supporting products which are readily observable to prospective customers from either side of said window;

(c) a removeable display panel between the display case and the inner surface of said window, said display panel having indicia formed thereon readable by said prospective customers and mounting holes formed therethrough which receive means to support said display panel; and (d) means for mounting said display case on one surface of said window with said rear face adjacent said one surface.

28. A merchandise display comprising:

(a) a substantially transparent window of a store having first and second opposite surfaces visible and accessible to prospective customers of said store;

(b) a display case including i. opposed sides having rear edges defining an open rear face therebetween; and ii. at least one shelf extending generally horizontally between said opposed sides and extending rearwardly of said open rear face supporting products which are readily observable to prospective customers from either side of said window;

(c) a display panel extending laterally beyond one of said opposed sides; and (d) means for mounting said display case on one surface of said window with said rear face adjacent said one surface.

29. A merchandise display as defined in claim 28 further comprising a second display panel extending laterally beyond the other of said opposed sides.

30. A merchandise display as defined in claim 28 further comprising an ultra-violet shield disposed between the rear face of said display case and the inner surface of said window.

31. A merchandise display as defined in claim 30 wherein said ultra-violet shield has mounting holes formed therethrough which receive the stems of said suction cups to support said ultra-violet shield.

32. A merchandise display as defined in claim 27 further comprising a front wall extending generally vertically upwardly from said support shelf and supporting indicia thereon.

33. A merchandise display as defined in claim 27 wherein said means for mounting comprises a plurality of suction cups, each having a stem connected to said display base and a suction hood facing rearwardly of said opposed sides.

34. A merchandise display as defined in claim 28 wherein said means for mounting comprises a plurality of suction cups, each having a stem connected to said display case and a suction head facing rearwardly of said opposed sides.

35. A merchandise display as defined in claim 28 further comprising a second shelf located above said shelf extending generally horizontally between said opposed sides and extending rearwardly of said rear face.

36. A merchandise display as defined in claim 28 further comprising a removeable display panel disposed between the display case and the inner surface of said window, said display panel having indicia formed thereon readable by said prospective customers.

* * * * *

UNITED STATES PATENT AND TRADEMARK OFFICE

CERTIFICATE OF CORRECTION

PATENT NO. : 5,351,841

DATED : October 4, 1994

INVENTOR(S) : Paul Belokin, et al.

It is certified that error appears in the above-identified patent and that said Letters Patent is hereby corrected as shown below:

Column 1, before line 5, insert ---This invention relates to advertising displays and merchandising cases. More particularly, it relates to merchandise display cases adapted for mounting on a transparent wall, window or the like which carry advertising displays visible from both sides of the transparent wall.---

Column 1, line 31, "nontransparent" should read ---non-transparent---

Signed and Sealed this

Third Day of January, 1995

*Attest:*

Bruce Lehman

BRUCE LEHMAN

*Attesting Officer*

*Commissioner of Patents and Trademarks*